US006748614B1

(12) United States Patent
Hu

(10) Patent No.: US 6,748,614 B1
(45) Date of Patent: Jun. 15, 2004

(54) REINFORCING STRUCTURE PREVENTING SICKBED FROM DEFORMATION

(75) Inventor: Ming-Hsiung Hu, Toyuan Hsien (TW)

(73) Assignee: Optima Healthcare Inc., Taoyuan Hsien (TW)

( * ) Notice: Subject to any disclaimer, the term of this patent is extended or adjusted under 35 U.S.C. 154(b) by 0 days.

(21) Appl. No.: 10/342,393

(22) Filed: Jan. 15, 2003

(51) Int. Cl.[7] ..... A47C 19/00
(52) U.S. Cl. ..... 5/620; 5/201; 5/282.1
(58) Field of Search ..... 5/620, 174, 201, 5/202, 282.1

(56) References Cited

U.S. PATENT DOCUMENTS 4,202,062 A * 5/1980 Marcyan ..... 5/620

* cited by examiner

*Primary Examiner*—Alexander Grosz
(74) *Attorney, Agent, or Firm*—Rosenberg, Klein & Lee

(57) ABSTRACT

A reinforcing plate having a Z-shaped profile with a raised section and an extended base plate is welded to the vertical aspect of a rear side rail of a sickbed comprised of a front and a rear frame. The front and rear frames of such a sickbed are connected to each other by engaging a hook formed at the end of the front side rails with a horizontal pin fixedly attached to both the vertical aspect of the rear side rail and the raised section of the reinforcing plate. The reinforcing plate provides important structural support to a vulnerable part of the sickbed frame and thereby augments the weight bearing capability of such a sickbed, and further protects the hook-and-pin coupling of the front and rear side rails from inadvertent displacement or other dislodging and deforming forces. The sickbed is therefore deemed to be safer than sickbeds of the prior art.

1 Claim, 5 Drawing Sheets

REINFORCING STRUCTURE PREVENTING SICKBED FROM DEFORMATION

FIELD OF THE INVENTION

The present invention is directed generally to a sickbed, and more particularly to a sickbed with a reinforcing structure in the form of a long plate connected to each side member of a rear frame of a sickbed to strengthen the sickbed frame so as to substantially reduce the risk of the frame being deformed and/or coming apart where the two halves of the sickbed are joined.

BACKGROUND OF THE INVENTION

In the prior art, a conventional sickbed 100 as shown in FIG. 3 is typically assembled from a front frame 1 and a rear frame 2, together with two end frames 3. The front and rear frames 1, 2 are reversibly connected to each other by engaging the hooks 11 provided at the inner ends of two side members of the front frame 1 with pins 21 that are correspondingly provided at inner ends of two angled side members of the rear frame. The hooked ends of the front end pivot around the pins 21 which project in a sideward manner from the outer surfaces of the vertical flanges of the angled side members, thereby coupling the front and rear frames 1, 2 together. This can further be appreciated in FIGS. 1 and 2.

The typical sickbed 100 of the prior art has a limited supporting capability because it has a central portion suspended between the end frames 3 and supported only by the connected hooks 11 and pins 21. A heavy load applied to either of the frames 1, 2, or a load heavily applied generally to the sickbed 100, tends to deform the hooks 11 and/or suspended frames 1, 2 as well as the pins 21, potentially causing the sickbed 100 frame to bend, twist, break and/or come apart.

SUMMARY OF THE INVENTION

It is a primary object of the present invention to provide a reinforcing structure for a sickbed, so that the side rails and the region where the front and rear frames of the sickbed are connected do not deform, or turn outward, or bend when the sickbed is subjected to an unevenly applied load or to a heavy load applied suddenly.

To achieve the above as well as other objectives, the reinforcing structure for preventing a sickbed from deforming according to the present invention includes a substantially Z-shaped angled reinforcing plate having a raised section provided at one of its ends and an extended base at its other end. The reinforcing plate has an angled contour in profile, much like a partly stretched-out Z. The base plate of a reinforcing plate is welded to a vertical flange of each rear side rail of the sickbed with the raised section fixedly connected to an outer end of the pin projected outwardly from the same vertical part of the angled side member. The base plates extend along the vertical flange of the rear side rails toward the rear end frame, providing substantial structural support and resistance of that part of the sickbed frame to deforming forces imposed upon it. The raised section of the reinforcing plate is fixedly connected to an outer end of a perpendicularly projecting pin that is fixedly connected at its other end to the corresponding vertical flange of the rear side rail. Hooks formed on the ends of the front side rails engage with the corresponding pins provided on the rear side rails, thereby sandwiching the hooked end of the front side rail between the rear side rail and the raised section of the reinforcing plate. This protective arrangement of the frame of a sickbed assembly substantially reduces the chances of the pins or side rails being deformed or displaced due to heavy or uneven loads being applied to the sickbed. The sickbed is deemed to be safer.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
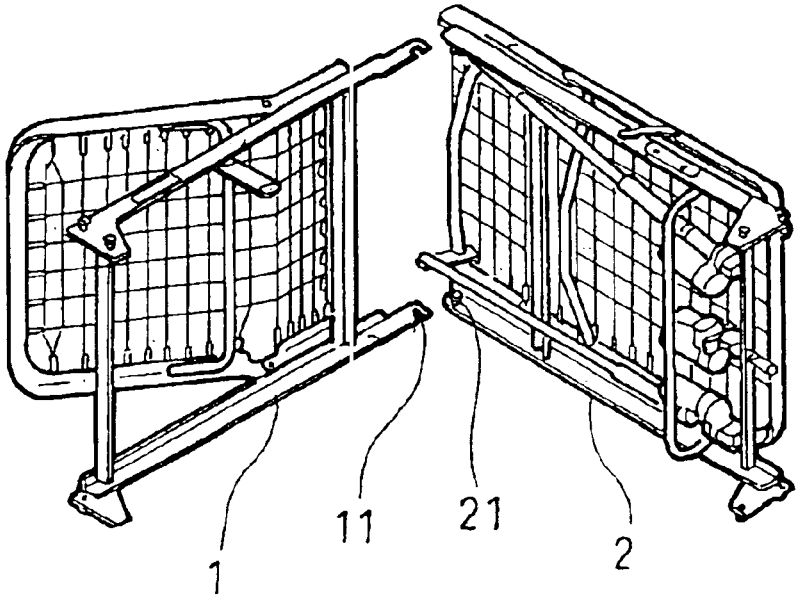
FIG. 1 is an exploded bottom perspective view of a conventional sickbed.
Figure 2:
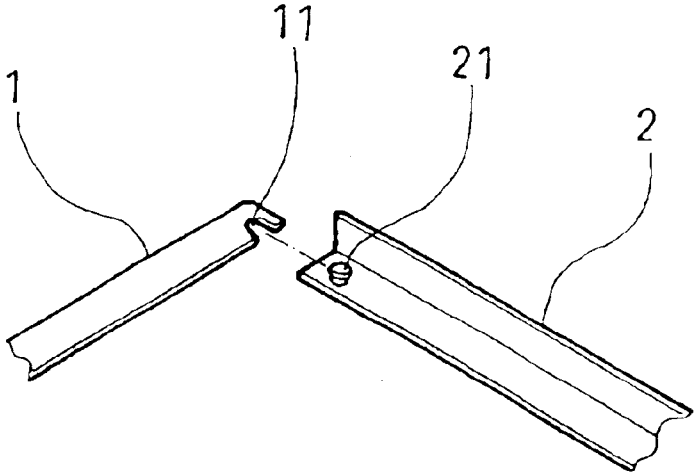
FIG. 2 is a fragmentary view of FIG. 1 showing the manner of connecting a front frame to a rear frame of the conventional sickbed of FIG. 1.
Figure 3:
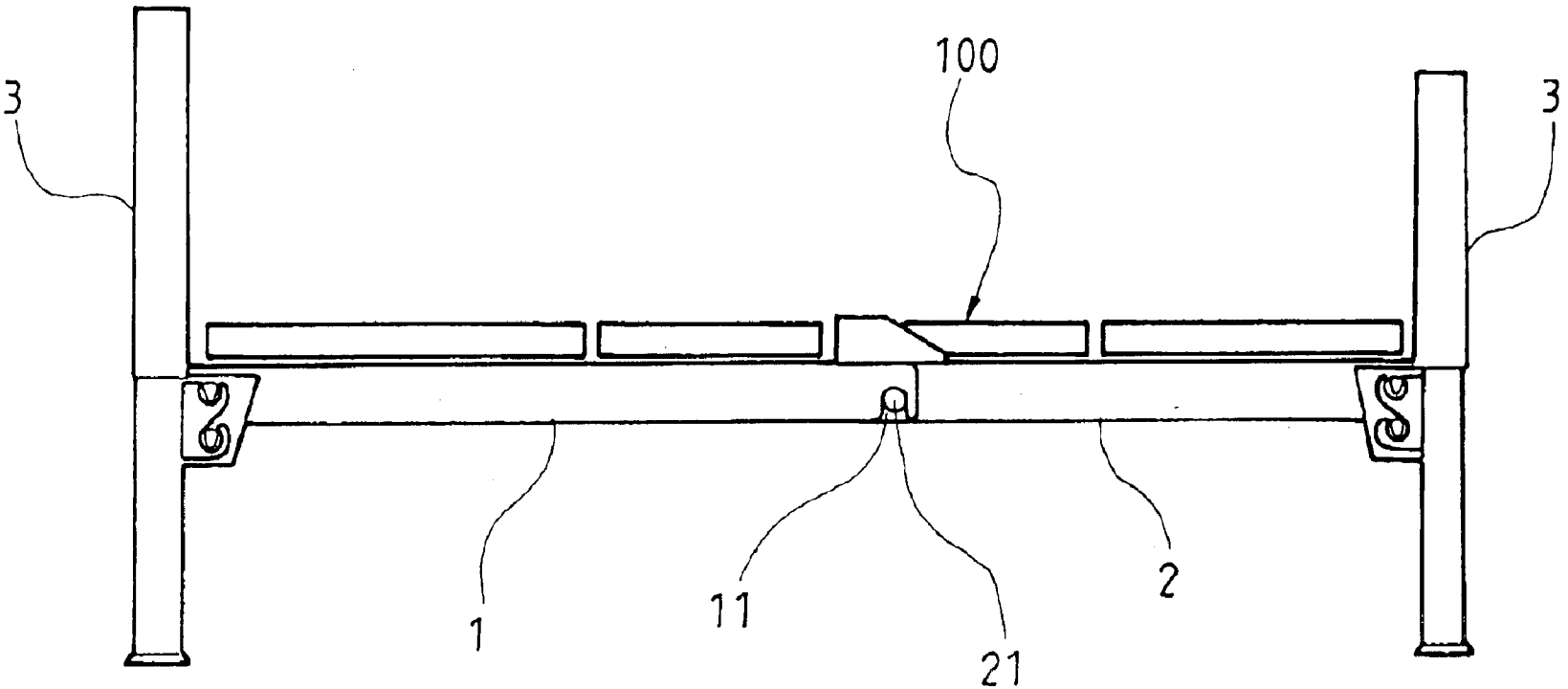
FIG. 3 is an assembled side view of the sickbed of FIG. 1.
Figure 4:
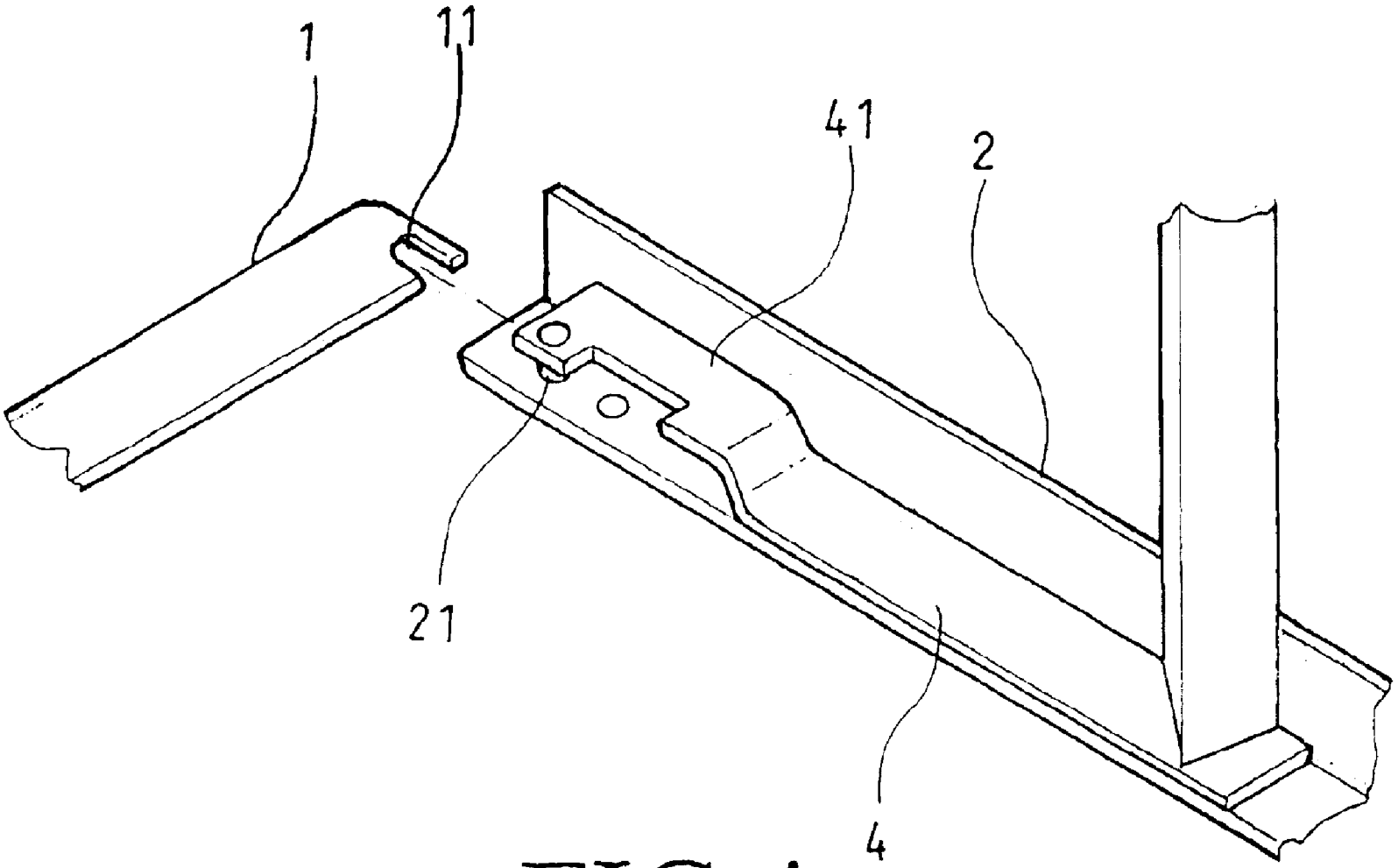
FIG. 4 is a fragmentary and exploded perspective view of a sickbed having a reinforcing structure according to the present invention for preventing the sickbed from deformation.
Figure 5:
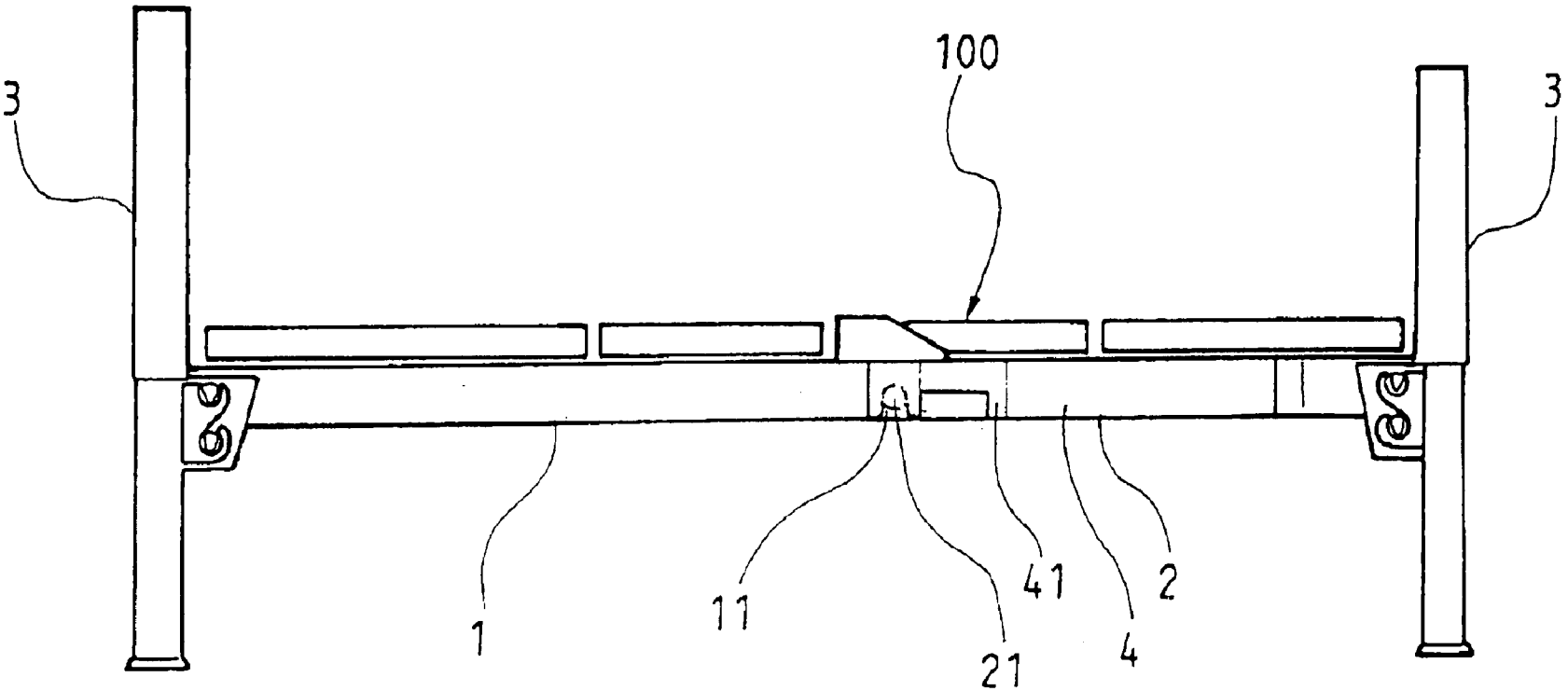
FIG. 5 is an assembled side view of a sickbed having the reinforcing structure of the present invention.

A side view of an assembled sickbed 100 is seen in FIG. 5, illustrating a sickbed formed by coupling two end frames 3 with a front and rear frame 1, 2 having a reinforcing structure of the present invention. The rear frame 2—synonymously called rear side rail 2—has an innovative reinforcing structure seen in the side view as the structures labeled 4 and 41. FIG. 4 is a fragmentary and exploded perspective view of the sickbed 100 showing inner ends of the front frame 1 and the rear frame 2. The front half of the sickbed 100 includes two side rails 1, each of which is provided at a lower inner end with an open-bottomed notch to form a hook 11. The front end frame 3 connects to the pair of front side rails 1. Similarly, The rear half of the sickbed 100, includes the two angled side rails, each of which includes a vertical and horizontal flange. In the preferred embodiment, each of the rear side rails 2 is provided at an inner aspect of the end most distant from the rear end frame with a pin 21 fixedly connected to the vertical flange of the rear side rail, projecting outward from that vertical part of the angled rear side rail. An angled and somewhat Z-shaped reinforcing plate 4, with a raised section 41 and a long base, is welded to an inner aspect of the vertical flange of rear side rail 2, as illustrated in FIG. 4. An innermost end of the raised section 41 of the reinforcing plate 4 is fixedly connected to an outer end of pin 21, so that a small length of pin 21 extends into the space between the vertical part of the rear side rail 2 and the raised section 41 of the reinforcing plate. The reinforcing plate 4 is formed with a raised section 41 connected with a sloping shorter section to an extended base; the base section of the reinforcing plate 4 is welded to the vertical aspect of the rear side rail, as is also shown in FIG. 5. Pin 21, which is fixedly attached to the vertical flange of the rear side rail, extends perpendicular to that vertical surface to fixedly attach to the raised section of the reinforcing plate.

Figure 6:
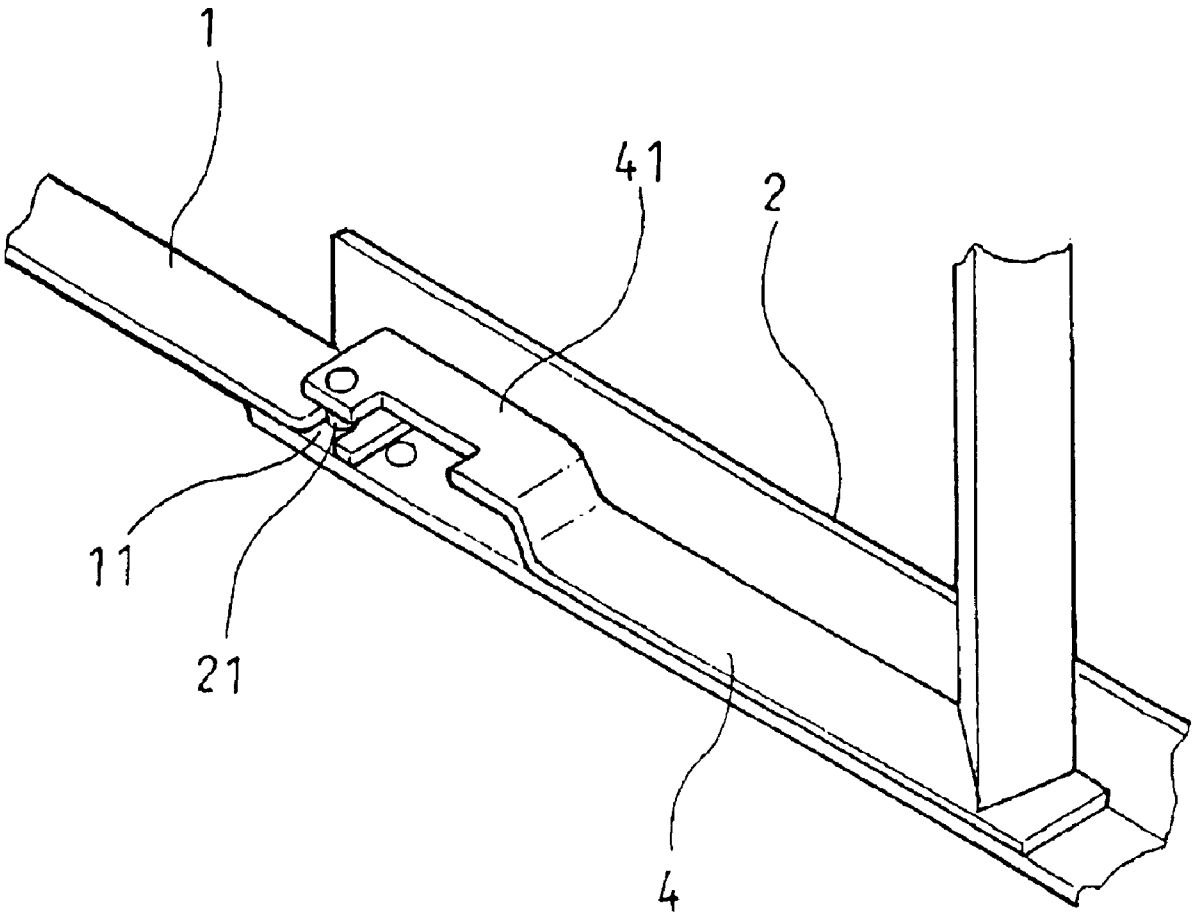
FIG. 6 is an assembled perspective view of FIG. 4.

FIG. 4 further illustrates the manner of joining the two ends of the sickbed. The hooks 11 formed at an end of the front side rails 1 are positioned into the space left between the raised section 41 of the reinforcing plate 4 and the vertical part of the angled side member of the rear frame 2 to pivotally engage with pin 21, and then the side rails are rotated into alignment. It can be appreciated by reference to FIG. 6 that in the coupled aligned relation, the front side rail has its hook containing end sandwiched between the vertical flange of the rear side rail and the raised section 41 of the reinforcing plate 4. It may further be appreciated that the positioning of this reinforcing plate 4, with its extended base welded to the rear side rail, provides important structural support to the sickbed frame, a feature significantly absent in the prior art.

The reinforcing plate 4 further provides protection functions to protect hook 11 of front side rail 1 by blocking any displacing movement of the front side rail 1 relative to pin 21. The raised section 41 further affords protection to the hook 11 of the front side rail 1 by reducing the risk of a sudden and/or heavy load causing the side rail to become deformed, as by twisting or otherwise turning in an undesirable manner. The use of the angled Z-shaped reinforcing plate 4 fixedly attached to rear side rail 2 augments the sickbed 100 weight bearing capability, providing structural support and an increased measure of safety. The reinforcing plate 4 not only provides added structural support to the rear side rail and increased weight bearing capability of the sickbed 100, but also guards against displacement of the front side rail 1 and its hook 11 from a coupling alignment with the rear side rail 2.

What is claimed is:

1. A reinforcing structure for a sickbed comprising:

(a) a front end frame and a rear end frame;

(b) a pair of front side rails, each joined at a first end to opposite sides of said front end frame and having a second end formed so as to define an open-bottomed notch to function as a hook;

(c) a pair of rear side rails, each with a third end and a fourth end, and joined to opposite sides of said rear end frame at said third end, and each being reversibly and pivotally connected at said fourth end to each of said pair of front side rails at said second ends respectively;

(d) a pair of Z-shaped reinforcing plates having a raised section and an extended base, with the extended base being welded to said rear side rails of said fourth ends; and, (e) a pair of pins fixedly attached to said fourth ends and extending in a substantially perpendicular relation to a longitudinal axis of said sickbed to fixedly attach to the raised sections of said reinforcing plates;

wherein the front and rear end frames are reversibly connected by engaging said hooks of the front side rails with and around the pins, wherein the hooks are thereby positioned between the raised sections of the reinforcing plates and the fourth ends of the rear side rails.

* * * * *